United States Patent [19]

Hasegawa et al.

[11] Patent Number: 4,498,445

[45] Date of Patent: Feb. 12, 1985

[54] AIR/FUEL RATIO FEEDBACK CONTROL SYSTEM ADAPTED TO OBTAIN STABLE ENGINE OPERATION UNDER PARTICULAR ENGINE OPERATING CONDITIONS

[75] Inventors: Shumpei Hasegawa, Niiza; Noriyuki Kishi, Tokyo; Takashi Koumura, Saitama, all of Japan

[73] Assignee: Honda Giken Kogyo Kabushiki Kaisha, Tokyo, Japan

[21] Appl. No.: 492,399

[22] Filed: May 6, 1983

[30] Foreign Application Priority Data

May 6, 1982 [JP] Japan ..... 57-75615

[51] Int. Cl.[3] ..... F02M 51/00

[52] U.S. Cl. ..... 123/489

[58] Field of Search ..... 123/440, 489

[56] References Cited

U.S. PATENT DOCUMENTS 4,391,256 7/1983 Sawada et al. ..... 123/489

4,397,279 8/1983 Iida ..... 123/489

4,445,482 5/1984 Hasegawa et al. ..... 123/489

*Primary Examiner*—Parshotam S. Lall

*Assistant Examiner*—W. R. Wolfe

*Attorney, Agent, or Firm*—Lyon & Lyon

[57] ABSTRACT

An air/fuel ratio feedback control system adapted to control the air/fuel ratio of an air/fuel mixture being supplied to an internal combustion engine, by the use of a coefficient having a value variable in response to actual exhaust gas concentration. The system is operable to calculate the mean value of values of the aforesaid coefficient for each of a plurality of subregions of the feedback control region when the engine is operating in such subregion. When the engine is operating in one of a plurality of particular operating regions other than the feedback control region, control of the air/fuel ratio is effected by the use of one of such mean values, selected from among the mean values so calculated for each of such particular operating regions, in place of the aforementioned coefficient.

2 Claims, 14 Drawing Figures

FIRST PROGRAM
1
SECOND PROGRAM
2
START CONTROL
3
BASIC CONTROL
4
ASYNCHRONOUS CONTROL
5
TiCRM,TiCRS TABLES
6,7
KNe TABLE
8
TV TABLE
9
BASIC Ti MAP
10
ACC/DEC SUBROUTINE
11
COEFFICIENT CALCULATING TABLES, SUBROUTINES
12
TV TABLE
9
TiA TABLE
13
KTW TABLE
14
TV TABLE
9

| FIG. 5A | FIG. 5B |
|---|---|

| FIG. 9A | FIG. 9B |
|---|---|

AIR/FUEL RATIO FEEDBACK CONTROL SYSTEM ADAPTED TO OBTAIN STABLE ENGINE OPERATION UNDER PARTICULAR ENGINE OPERATING CONDITIONS

BACKGROUND OF THE INVENTION

This invention relates to an air/fuel ratio feedback control system for performing by electronic means feedback control of the air/fuel ratio of an air/fuel mixture being supplied to an internal combustion engine, and more particularly to an air/fuel ratio feedback control system of this kind, which is capable of positively controlling the air/fuel ratio to predetermined values best suited for respective particular operating conditions of the engine when the engine is operating in a plurality of particular operating conditions, to thereby achieve improved operational stability and driveability of the engine.

A fuel supply control system adapted for use with an internal combustion engine, particularly a gasoline engine has been proposed e.g. by U.S. Pat. No. 3,483,851, which is adapted to determine the valve opening period of a fuel quantity metering or adjusting means for control of the fuel injection quantity, i.e. the air/fuel ratio of an air/fuel mixture being supplied to the engine, by first determining a basic value of the above valve opening period as a function of engine rpm and intake pipe absolute pressure and then adding to and/or multiplying same by constants and/or coefficients being functions of engine rpm, intake pipe absolute pressure, engine temperature, throttle valve opening, exhaust gas ingredient concentration (oxygen concentration), etc., by electronic computing means.

Also, in an engine having a three-way catalyst arranged in its exhaust system, it is generally employed to control the air/fuel ratio of the mixture to a theoretical mixture ratio in a feedback manner responsive to the output of an exhaust gas concentration sensor which may be represented by an $O_2$ sensor, arranged in the exhaust system of the engine, to obtain the best conversion efficiency of unburned hydrocarbons, carbon monoxide and nitrous oxides in the exhaust gases emitted from the engine. However, this feedback control based upon the output of the exhaust gas sensor cannot be applied when the engine is operating in a particular operating condition such as engine idle, wide-open-throttle, partial load, and deceleration where the air/fuel ratio of the mixture needs to be controlled to a value different from the theoretical mixture ratio.

Therefore, in the case of applying the above exhaust gas concentration-based feedback to the aforementioned fuel supply control system using coefficients, etc., it is necessary to carry out open-loop control when the engine is operating in a plurality of such particular operating conditions, by using coefficients having predetermined values corresponding to the respective particular operating conditions, so as to achieve desired predetermined air/fuel ratios best suited for engine operation under the above respective particular operating conditions.

It is thus desirable that the predetermined air/fuel ratio corresponding to the particular operating condition can be achieved with certainty by means of open-loop control. However, as a matter of fact, the actual air/fuel ratio can sometimes have a value different from the desired predetermined value due to variations in the performance of various sensors for detecting the operating condition of the engine and a system for controlling or driving the fuel quantity metering or adjusting means. In such event, it is impossible to obtain required operational stability and driveability of the engine.

OBJECT AND SUMMARY OF THE INVENTION

It is the object of the invention to provide an air/fuel ratio feedback control system for use with an internal combustion engine, which is capable of controlling the air/fuel ratio of the mixture to predetermined values or values very close thereto corresponding to respective particular operating conditions of the engine, when the engine is operating in the above particular operating conditions, to thereby assure achievement of required operational stability and driveability of the engine.

The present invention provides an air/fuel ratio feedback control system for use in an internal combustion engine, which includes a sensor arranged in the exhaust system of the engine, for detecting the concentration of exhaust gases emitted from the engine, and electrical circuit means for controlling the air/fuel ratio of an air/fuel mixture being supplied to the engine by the use of a first coefficient having a value variable in response to the output of the exhaust gas concentration sensor when the engine is operating in a feedback control subregion. The control system is characterized in that the above electrical circuit means comprises means for detecting operating conditions of the engine inclusive of a plurality of divided subregions of the feedback control region and a plurality of particular operating regions other than the feedback control region, means for calculating a mean value of values of the first coefficient occurring when the engine is operating in each of the divided subregions of the feedback control region, means for selecting one of such calculated mean values of the first coefficient corresponding to each of the particular operating regions when it is detected by the operating condition detecting means that the engine is operating in the above each particular operating region, and means for controlling the air/fuel ratio of the air/fuel mixture being supplied to the engine by the use of the above one selected mean value in place of the first coefficient while the engine is operating in each of the particular operating regions. Thus, during open-loop control of the air/fuel ratio during engine operation in each of the particular operating regions, the use of a mean value of values of the selected first coefficient makes it possible to obtain an air/fuel ratio closer to a desired air/fuel ratio best suited for the engine operation in that particular operating region, thereby obtaining improved operating stability and driveability.

Preferably, the aforesaid electrical circuit means includes means for generating at least one second coefficient having a value variable in response to the outputs generated by the engine operating condition detecting means, referred to before, this second coefficient generating means being operable to hold the value of the second coefficient at a first predetermined value while the engine is operating in the feedback control region and to hold the value of the second coefficient at a second predetermined value corresponding to one of the particular operating regions, while the engine is operating in the above one particular operating region, means operable to control the air/fuel ratio of the air/fuel mixture by the use of both the first coefficient and the second coefficient while the engine is operating in the feedback control region and by the use of one of the selected mean values of values of the first coefficient and the second coefficient while the engine is operating in one of the particular operating regions to which the selected mean value corresponds, in order to obtain an air/fuel ratio more closer to a desired air/fuel ratio best suited for the engine operation in a particular operating condition of the engine, thereby making it possible to control the air/fuel ratio of the air/fuel mixture being supplied to the engine with accuracy.

The above and other objects, features and advantages of the invention will be more apparent from the ensuing detailed description taken in connection with the accompanying drawings.

DETAILED DESCRIPTION

The present invention will now be described in detail with reference to the drawings.

Figure 1:
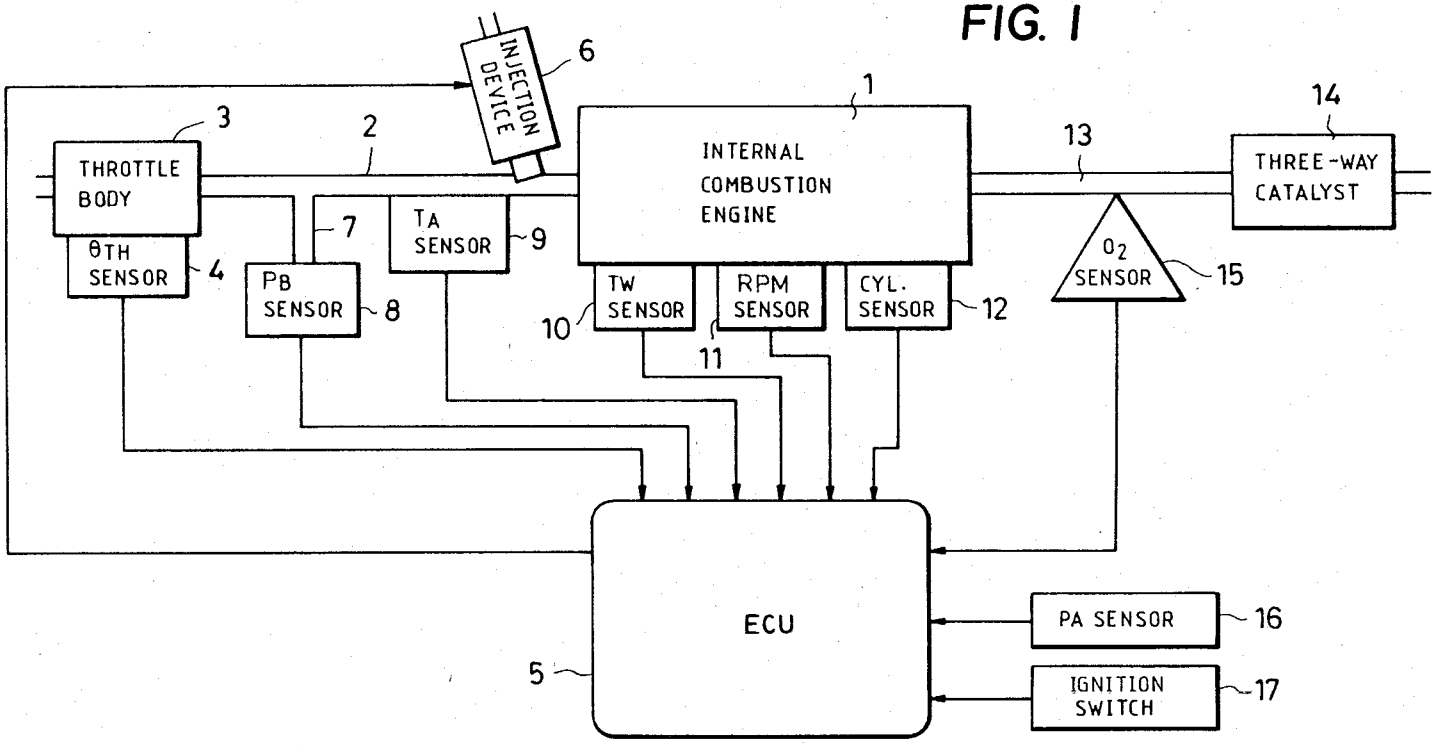
FIG. 1 is a block diagram illustrating the whole arrangement of an air/fuel ratio feedback control system according to the present invention.

Referring first to FIG. 1, there is illustrated the whole arrangement of a fuel supply control system for internal combustion engines, to which the present invention is applicable. Reference numeral 1 designates an internal combustion engine which may be a four-cylinder type, for instance. This engine 1 has main combustion chambers which may be four in number and sub combustion chambers communicating with the main combustion chambers, none of which is shown. An intake pipe 2 is connected to the engine 1, which comprises a main intake pipe communicating with each main combustion chamber, and a sub intake pipe with each sub combustion chamber, respectively, neither of which is shown. Arranged across the intake pipe 2 is a throttle body 3 which accommodates a main throttle valve and a sub throttle valve mounted in the main intake pipe and the sub intake pipe, respectively, for synchronous operation. Neither of the two throttle valves is shown. A throttle valve opening sensor 4 is connected to the main throttle valve for detecting its valve opening and converting same into an electrical signal which is supplied to an electronic control unit (hereinafter called "ECU") 5.

A fuel injection device 6 arranged in the intake pipe 2 at a location between the engine 1 and the throttle body 3, which comprises main injectors and a subinjector, none of which is shown. The main injectors correspond in number to the engine cylinders and are each arranged in the main intake pipe at a location slightly upstream of an intake valve, not shown, of a corresponding engine cylinder, while the subinjector, which is single in number, is arranged in the sub intake pipe at a location slightly downstream of the sub throttle valve, for supplying fuel to all the engine cylinders. The main injectors and the subinjector are electrically connected to the ECU 5 in a manner having their valve opening periods or fuel injection quantities controlled by signals supplied from the ECU 5.

On the other hand, an absolute pressure sensor 8 communicates through a conduit 7 with the interior of the main intake pipe of the throttle body 3 at a location immediately downstream of the main throttle valve. The absolute pressure sensor 8 is adapted to detect absolute pressure in the intake pipe 2 and applies an electrical signal indicative of detected absolute pressure to the ECU 5. An intake-air temperature sensor 9 is arranged in the intake pipe 2 at a location downstream of absolute pressure sensor 8 and also electrically connected to the ECU 5 for supplying thereto an electrical signal indicative of detected intake-air temperature.

An engine temperature sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rpm sensor (hereinafter called "Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle each time the engine crankshaft rotates through 180 degrees, i.e., upon generation of each pulse of the top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure and an ignition switch 17 for actuating the ignition device, not shown, of the engine 1, respectively, for supplying an electrical signal indicative of detected atmospheric pressure and an electrical signal indicative of its own on and off positions to the ECU 5.

Next, the fuel quantity control operation of the air/fuel ratio feedback control system of the invention arranged as above will now be described in detail with reference to FIG. 1 referred to hereinabove and FIGS. 2 through 10.

Figure 2:
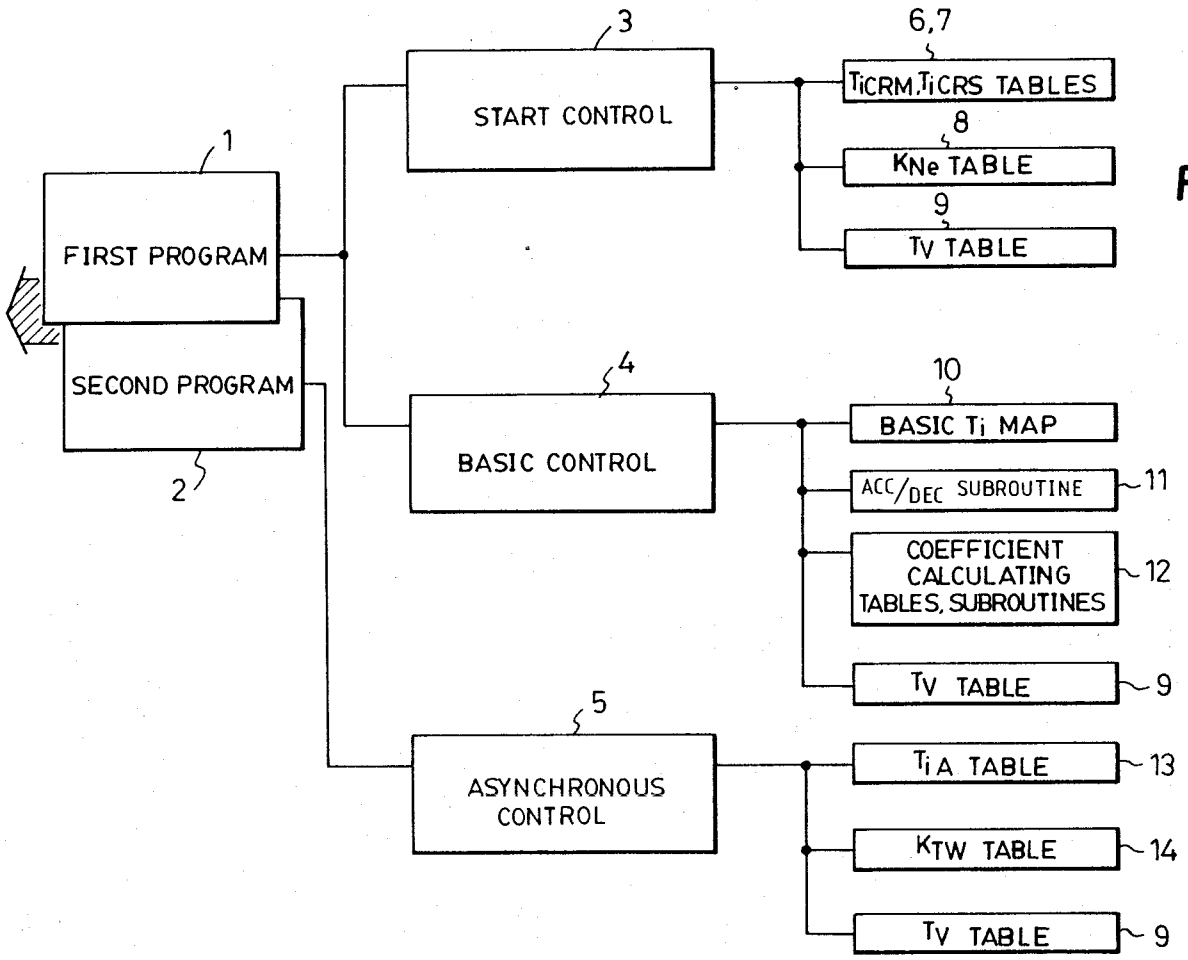
FIG. 2 is a block diagram illustrating a program for control of the valve opening periods TOUTM, TOUTS of the main injectors and the subinjector, which are operated by an electronic control unit (ECU) in FIG. 1.

Referring first to FIG. 2, there is illustrated a block diagram showing the whole program for air/fuel ratio control, i.e. control of valve opening periods TOUTM, TOUTS of the main injectors and the subinjector, which is executed by the ECU 5. The program comprises a first program 1 and a second program 2. The first program 1 is used for fuel quantity control in synchronism with the TDC signal, hereinafter merely called "synchronous control" unless otherwise specified, and comprises a start control subroutine 3 and a basic control subroutine 4, while the second program 2 comprises an asynchronous control subroutine 5 which is carried out in asynchronism with or independently of the TDC signal.

In the start control subroutine 3, the valve opening periods TOUTM and TOUTS are determined by the following basic equations:

$$TOUTM = TiCMR \times KNe + (TV + \Delta TM) \quad (1)$$

$$TOUTS = TiCRS \times KNe + TV \quad (2)$$

where TiCRM, TiCRS represent basic values of the valve opening periods for the main injectors and the subinjector, respectively, which are determined from a TiCRM table 6 and a TiCRS table 7, respectively, KNe represents a correction coefficient applicable at the start of the engine, which is variable as a function of engine rpm Ne and determined from a KNe table 8, and TV represents a constant for increasing and decreasing the valve opening period in response to changes in the output voltage of the battery, which is determined from a TV table 9. ΔTV is added to TV applicable to the main injectors as distinct from TV applicable to the subinjector, because the main injectors are structurally different from the subinjector and therefore have different operating characteristics.

The basic equations for determining the values of TOUTM and TOUTS applicable to the basic control subroutine 4 are as follows:

$$TOUTM = (TiM - TDEC) \times (KTA \times KTW \times KAFC \times KPA \times KAST \times KWOT \times KO_2 \times KLS) + TACC \times (KTA \times KTWT \times KAFC) + (TV + \Delta TV) \quad (3)$$

$$TOUTS = (TiS - TDEC) \times (KTA \times KTW \times KAST \times KPA) + TV \quad (4)$$

where TiM, TiS represent basic values of the valve opening periods for the main injectors and the subinjector, respectively, and are determined from a basic Ti map 10, and TDEC, TACC represent constants applicable, respectively, at engine deceleration and at engine acceleration and are determined by acceleration and deceleration subroutines 11. The coefficients KTA, KTW, etc. are determined by their respective tables and/or subroutines 12. KTA is an intake air temperature-dependent correction coefficient and is determined from a table as a function of actual intake air temperature, KTW a fuel increasing coefficient which is determined from a table as a function of actual engine cooling water temperature TW, KAFC a fuel increasing coefficient applicable after fuel cut operation and determined by a subroutine, KPA an atmospheric pressure-dependent correction coefficient determined from a table as a function of actual atmospheric pressure, and KAST a fuel increasing coefficient applicable after the start of the engine and determined by a subroutine. KWOT is a coefficient for enriching the air/fuel mixture, which is applicable at wide-open-throttle and has a constant value, $KO_2$ an "$O_2$ feedback control" correction coefficient determined by a subroutine as a function of actual oxygen concentration in the exhaust gases, and KLS a mixture-leaning coefficient applicable at "lean stoich." operation and having a constant value. The term "stoich." is an abbreviation of a word "stoichiometric" and means a stoichiometric or theoretical air/fuel ratio of the mixture.

On the other hand, the valve opening period TMA for the main injectors which is applicable in asynchronism with the TDC signal is determined by the following equation:

$$TMA = TiA \times KTWT \times KAST + (TV + \Delta TV) \quad (5)$$

where TiA represents a TDC signal-asynchronous fuel increasing basic value applicable at engine acceleration and in asynchronism with the TDC signal. This TiA value is determined from a TiA table 13. KTWT is defined as a fuel increasing coefficient applicable at and after TDC signal-synchronous acceleration control as well as at TDC signal-asynchronous acceleration control, and is calculated from a value of the aforementioned water temperature-dependent fuel increasing coefficient KTW obtained from the table 14.

Figure 3:
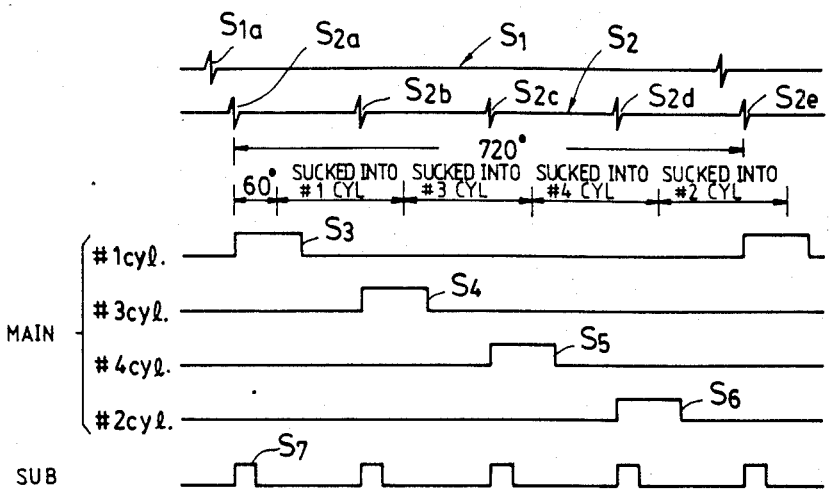
FIG. 3 is a timing chart showing the relationship between a cylinder-discriminating signal and a TDC signal inputted to the ECU, and drive signals for the main injectors and the subinjector, outputted from the ECU.

FIG. 3 is a timing chart showing the relationship between the cylinder-discriminating signal and the TDC signal, both inputted to the ECU 5, and the driving signals outputted from the ECU 5 for driving the main injectors and the subinjector. The cylinder-discriminating signal $S_1$ is inputted to the ECU 5 in the form of a pulse $S_1a$ each time the engine crankshaft rotates through 720 degrees. Pulses $S_2a$–$S_2e$ forming the TDC signal $S_2$ are each inputted to the ECU 5 each time the engine crankshaft rotates through 180 degrees. The relationship in timing between the two signals $S_1$, $S_2$ determines the output timing of driving signals $S_3$–$S_6$ for driving the main injectors of the four engine cylinders. More specifically, the driving signal $S_3$ is outputted for driving the main injector of the first engine cylinder, concurrently with the first TDC signal pulse $S_2a$, the driving signal $S_4$ for the third engine cylinder concurrently with the second TDC signal pulse $S_2b$, the driving signal $S_5$ for the fourth cylinder concurrently with the third pulse $S_2c$, and the driving signal $S_6$ for the second cylinder concurrently with the fourth pulse $S_2d$, respectively. The subinjector driving signal $S_7$ is generated in the form of a pulse upon application of each pulse of the TDC signal to the ECU 5, that is, each time the crankshaft rotates through 180 degrees. It is so arranged that the pulses $S_2a$, $S_2b$, etc. of the TDC signal are each generated earlier by 60 degrees than the time when the piston in an associated engine cylinder reaches its top dead center, so as to compensate for arithmetic operation lag in the ECU 5, and a time lag between the formation of a mixture and the suction of the mixture into the engine cylinder, which depends upon the opening action of the intake pipe before the piston reaches its top dead center and the operation of the associated injector.

Figure 4:
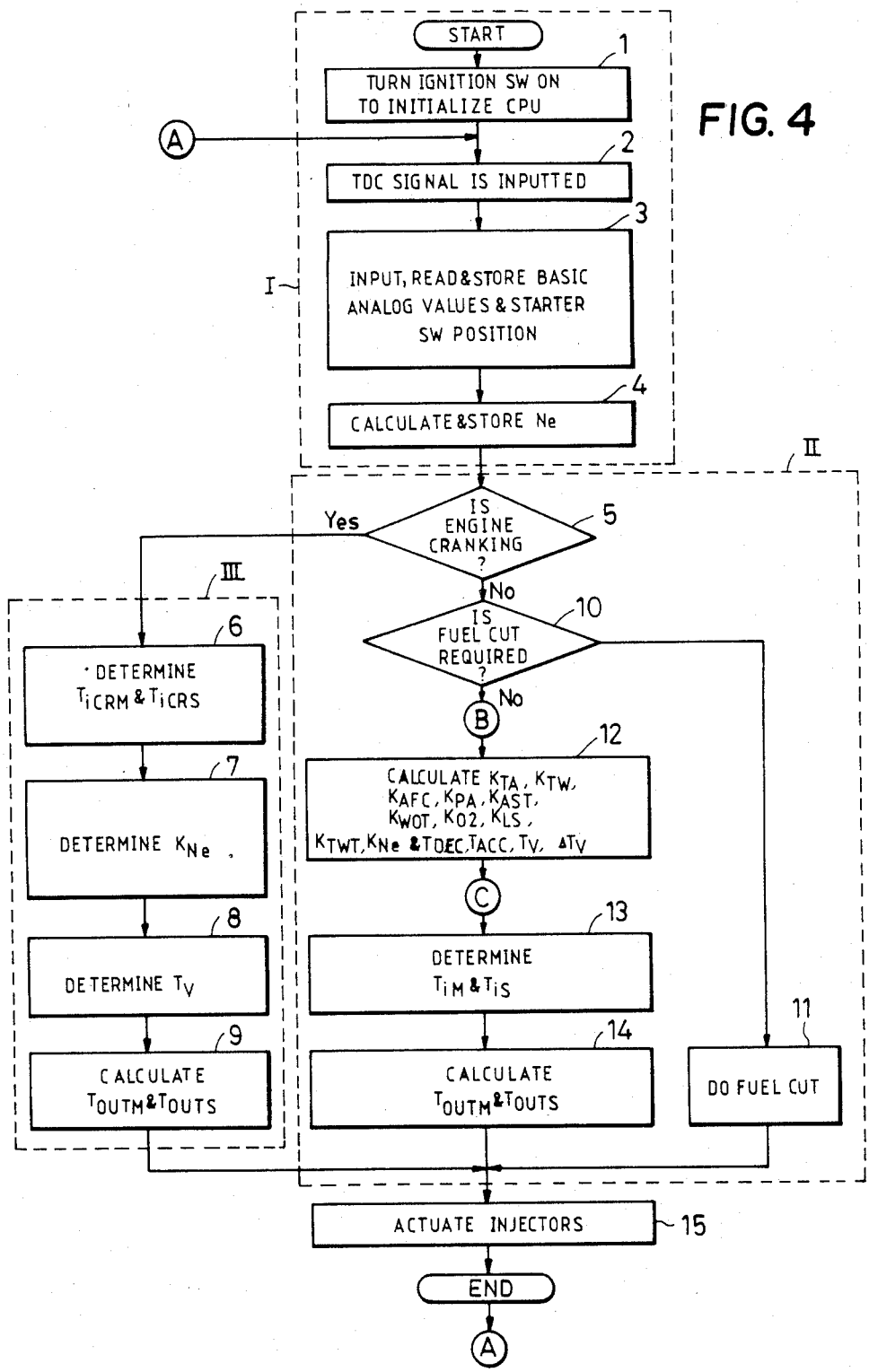
FIG. 4 is a flow chart showing a main program for control of the basic valve opening periods TOUTM, TOUTS.

Referring next to FIG. 4, there is shown a flow chart of the aforementioned first program 1 for control of the valve opening period in synchronism with the TDC signal in the ECU 5. The whole program comprises an input signal processing block I, a basic control block II and a start control block III. First in the input signal processing block I, when the ignition switch of the engine is turned on, CPU in the ECU 5 is initialized at the step 1 and the TDC signal is inputted to the ECU 5 as the engine starts at the step 2. Then, all basic analog values are inputted to the ECU 5, which include detected values of atmospheric pressure PA, absolute pressure PB, engine cooling water temperature TW, atmospheric air temperature TA, throttle valve opening $\theta$th, battery voltage V, output voltage value V of the $O_2$ sensor and on-off state of the starter switch 17, not shown in FIG. 1, some necessary ones of which are then stored therein (step 3). Further, the period between a pulse of the TDC signal and the next pulse of same is counted to calculate actual engine rpm Ne on the basis of the counted values, and the calculated value is stored in the ECU 5 (step 4). The program then proceeds to the basic control block II. In this block, a determination is made, using the calculated Ne value, as to whether or not the engine rpm is smaller than the cranking rpm (starting rpm) at the step 5. If the answer is affirmative, the program proceeds to the start control subroutine III. In this block, values of TiCRM and TiCRS are selected from a TiCRM table and a TiCRS table, respectively, on the basis of the detected value of engine cooling water temperature TW (step 6). Also, the value of Ne-dependent correction coefficient KNe is determined by using the KNe table (step 7). Further, the value of battery voltage-dependent correction constant TV is determined by using the TV table (step 8). These determined values are applied to the aformentioned equations (1), (2) to calculate the values of TOUTM, TOUTS (step 9).

If the answer to the question of the above step 5 is no, it is determined whether or not the engine is in a condition for carrying out fuel cut, at the step 10. If the answer is yes, the values of TOUTM and TOUTS are both set to zero, at the step 11.

On the other hand, if the answer to the question of the step 10 is negative, calculations are carried out of values of correction coefficients KTA, KTW, KAFC, KPA, KAST, KWOT, $KO_2$, KLS, KTWT, etc. and values of correction constants TDEC, TACC, TV, and $\Delta$TV, by means of the respective calculation subroutines and tables, at the step 12.

Then, basic valve opening period values TiM and TiS are selected from respective maps of the TiM value and the TiS value, which correspond to data of actual engine rpm Ne and actual absolute pressure PB and/or like parameters, at the step 13.

Then, calculations are carried out of the values TOUTM, TOUTS on the basis of the values of correction coefficients and correction constants selected at the steps 12 and 13, as described above, using the aforementioned equations (3), (4) (the step 14). The main injectors and the subinjector are actuated with valve opening periods corresponding to the values of TOUTM, TOUTS obtained by the aforementioned steps 9, 11 and 14 (the step 15).

As previously stated, in addition to the above-described control of the valve opening periods of the main injectors and the subinjector in synchronism with the TDC signal, asynchronous control of the valve opening periods of the main injectors is carried out in a manner asynchronous with the TDC signal but synchronous with a certain pulse signal having a constant pulse repetition period, detailed description of which is omitted here.

Figures 5, 5B:
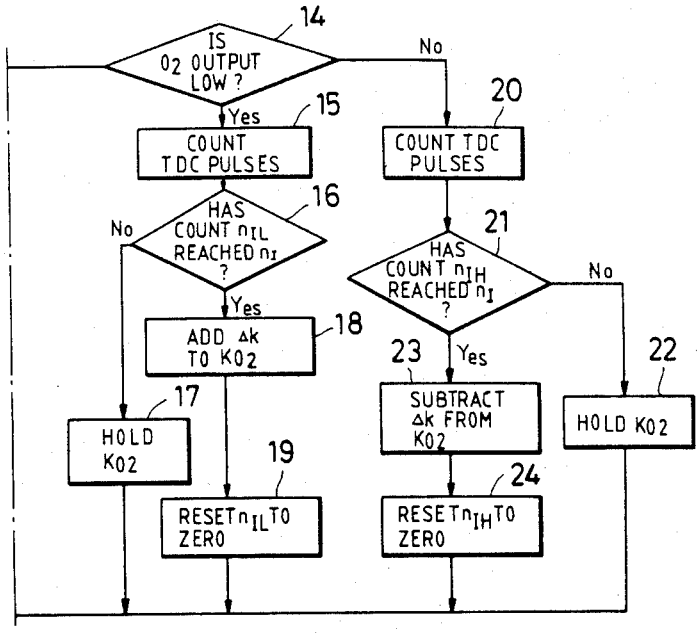
FIGS. 5A and 5B are a flow chart showing a subroutine for calculation of the value of "$O_2$-feedback control" correction coefficient $KO_2$.
Figure 5A:
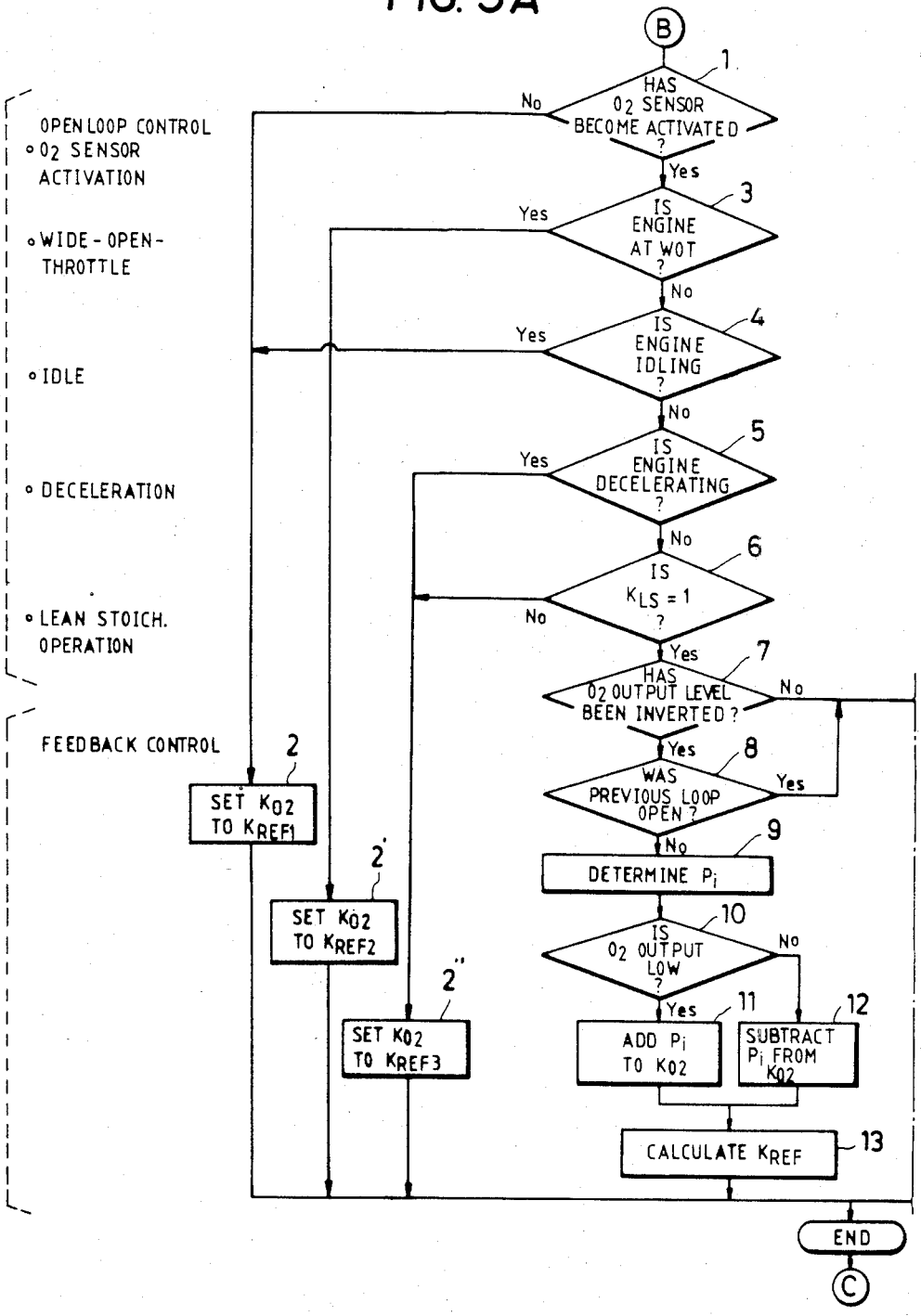

The subroutine for calculating the value of "$O_2$ feedback control" correction coefficient $KO_2$ will now be described with reference to FIG. 5 showing a flow chart of the same subroutine.

First, a determination is made as to whether or not the $O_2$ sensor has become activated, at the step 1. More specifically, by utilizing the internal resistance of the $O_2$ sensor, it is detected whether or not the output voltage of the $O_2$ sensor has dropped to an initial activation point VX (e.g. 0.6 volt). Upon the point VX being reached, an activation-indicative signal is generated which actuates an associated activation delay timer to start counting a predetermined period of time (e.g. 60 seconds). At the same time, it is determined whether or not both the water temperature-dependent fuel increasing coefficient KTW and the after-start fuel increasing coefficient KAST are equal to 1. If all the above conditions are found to be fulfilled, it is then determined that the $O_2$ sensor has been activated. If the activation of the $O_2$ sensor is negated at the step 1, the value of correction coefficient $KO_2$ is set to a mean value KREF1, referred to later, which has been obtained in the last feedback control operation based on the $O_2$ sensor output, at the step 2. When the $O_2$ sensor is found to be activated, a determination is made as to whether or not the throttle valve is fully opened (wide-open-throttle), at the step 3. If the answer is yes, the value of $KO_2$ is also set to the above mean value $KREF_2$ as best suited for wide open throttle operation, in a manner described later at the step 2'. If the throttle valve is not fully opened, whether or not the engine is at idle is determined at the step 4. To be concrete, if the engine rpm Ne is smaller than a predetermined value NIDL (e.g. 1000 rpm) and the absolute pressure PB is lower than a predetermined value PBIDL (e.g. 360 mmHg), the engine is judged to be idling, and then the above step 2 is executed to set the $KO_2$ value to the value KREF1 as best suited for idling operating condition. If the engine is not found to be idling, whether or not the engine is decelerating is determined at the step 5. To be concrete, it is judged that the engine is decelerating, when the absolute pressure PB is lower than a predetermined value PBDEC (e.g. 200 mmHg), and then the value of $KO_2$ is held at the above value KREF3 as best suited for this operating condition, at the step 2. On the other hand, if it is determined that the engine is not decelerating, it is determined whether or not the engine is operating in lean stoich. operation, at the step 6. If the answer is no, the $KO_2$ value is also held at the above value KREF3 at the step 2'', while if the answer is yes, the program proceeds to the closed loop control which will be described below.

Figure 6:
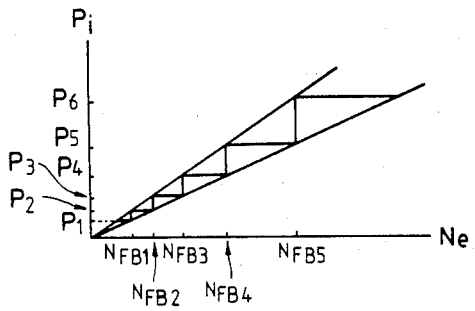
FIG. 6 is a view showing an Ne-Pi table for determining a correction value Pi for correcting "$O_2$-feedback control" correction coefficient $KO_2$.
Figure 8:
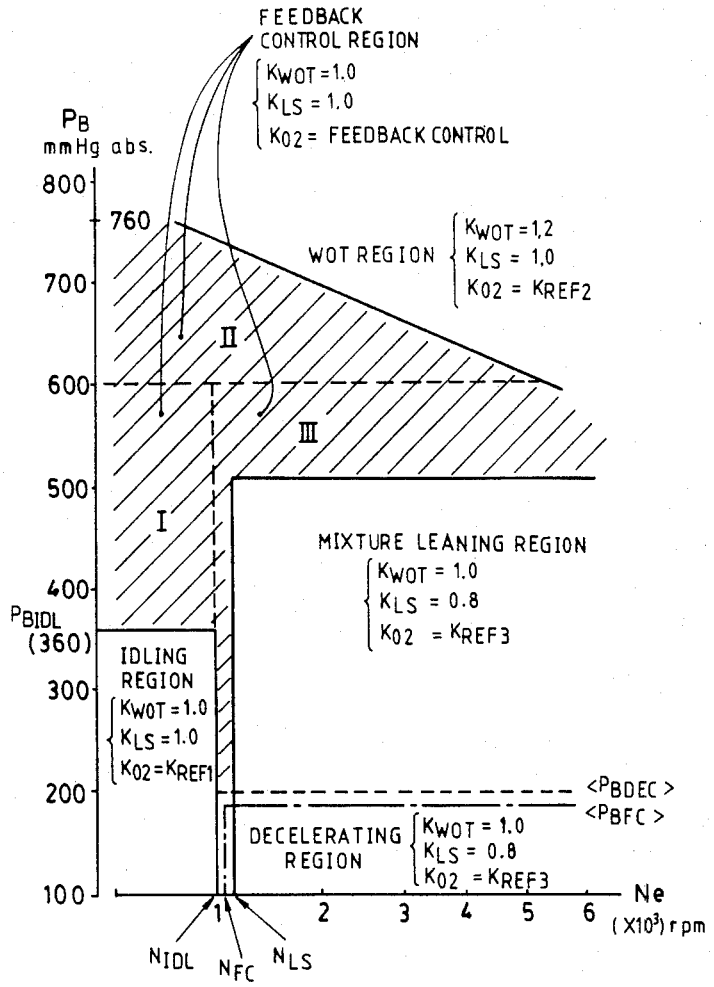
FIG. 8 is a graph showing a manner of applying correction coefficients to various operating conditions of the engine.

In the closed loop control, it is first determined whether or not there has occurred an inversion in the output level of the $O_2$ sensor, at the step 7. If the answer is affirmative, whether or not the previous loop was an open loop is determined at the step 8. If it has been determined that the previous loop was not an open loop, the air/fuel ratio of the mixture is controlled by proportional term control (P-term control). More specifically, referring to FIG. 6 showing an Ne-Pi table for determining a correction amount Pi by which the coefficient $KO_2$ is corrected, five different predetermined Ne values $NFB_{1-5}$ are provided which has values falling within a range from 1500 rpm to 3500 rpm, while five different predetermined Pi values $P_{1-6}$ are provided in relation to the above Ne values, by way of example. Thus, the value of correction amount Pi is determined from the engine rpm Ne at the step 9, which is added to or subtracted from the coefficient $KO_2$ upon each inversion of the output level of the $O_2$ sensor. Then, whether or not the output level of the $O_2$ sensor is low is determined at the step 10. If the answer is yes, the Pi value obtained from the table of FIG. 6 is added to the coefficient $KO_2$, at the step 11, while if the answer is no, the former is subtracted from the latter at the step 12. Then, a mean value KREFi corresponding to the present operation of the engine in feedback control region, is calculated from the value of $KO_2$ thus obtained, at the step 13. More specifically, as shown in FIG. 8, the feedback control region is divided in three subregions I–III and the KREFi value is calculated separately for each one of these regions by the use of $KO_2$ values obtained during engine operation in each of these regions. Calculation of the mean value KREFi can be made by the use of the following equation:

$$KREFi = \frac{CREFi}{A} \times KO_{2p} + \frac{A - CREFi}{A} \times KREFi' \quad (6)$$

where $KO_2p$ represents a value of $KO_2$ obtained immediately before or immediately after a proportional term (P-term) control action, A a constant (e.g. 256), CREFi a variable which is experimentally determined for each of these regions and set within a range from 1 to A-1, and KREFi' a mean value of values $KO_2$ obtained from the start of the first operation of an associated control circuit to the last proportional term control action inclusive.

Since the value of the variable CREFi determines the ratio of the value $KO_2p$ obtained at each P-term control action, to the value KREFi, an optimum value KREFi for each region can be obtained by setting the value CREFi to a suitable value within the range from 1 to A-1 depending upon the specifications of an air/fuel ratio control system, an engine, etc. to which the invention is applied.

Figure 7:
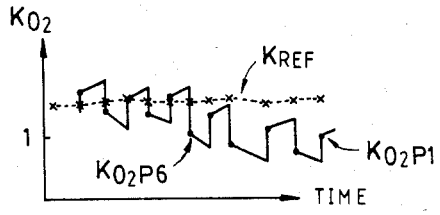
FIG. 7 is a graph showing a manner of detecting the value of correction coefficient $KO_2$ by means of proportional term control.

As noted above, the value KREFi is calculated on the basis of a value $KO_2p$ obtained immediately before or immediately after each P-term control action. This is because an air/fuel ratio of the mixture being supplied to the engine occurring immediately before or immediately after a P-term control action, that is, at an instant of inversion of the output level of the $O_2$ sensor shows a value most close to the theoretical mixture ratio (14.7). Thus, a mean value of $KO_2$ values can be obtained which are each calculated at an instant when the actual air/fuel ratio of the mixture shows a value most close to the theoretical mixture ratio, thus making it possible to calculate a value KREFi most appropriate to the actual operating condition of the engine. FIG. 7 is a graph showing a manner of detecting (calculating) the value $KO_2p$ at an instant immediately after each P-term control action. In FIG. 7, the mark . indicates a value $KO_2p$ detected immediately after a P-term control action, and $KO_2p1$ is an up-to-date value detected at the present time, while $KO_2P6$ is a value detected immediately after a P-term control action which is a sixth action from the present time.

The mean value KREFi can also be calculated from the following equation, in place of the aforementioned equation (6):

$$KREFi = \frac{1}{B} \sum_{j=1}^{B} KO_{2pj} \quad (7)$$

where $KO_2pj$ represents a value of $KO_2p$ obtained immediately before or immediately after a jth P-term control action before the present one, and B a constant which is equal to a predetermined number of P-term control actions (a predetermined number of inversions of the $O_2$ sensor output) subjected to calculation of the mean value. The larger the value of B, the larger the ratio of each value $KO_2p$ to the value KREFi. The value of B is set at a suitable value depending upon the specifications of an air/fuel ratio feedback control system, an engine, etc. to which the invention is applied. According to the equation (7), calculation is made of the sum of the values of $KO_2pj$ from the P-term control action taking place B times before the present P-term control action to the present P-term control action, each time a value of $Ko_2pj$ is obtained, and the mean value of these values of $Ko_2pj$ forming the sum is calculated.

Further, according to the above equations (6) and (7), the mean value KREFi is renewed each time a new value of $KO_2p$ is obtained during engine operation in each subregion of the feedback control regions based upon the $O_2$ sensor output, by applying the above new value of $KO_2p$ to the equations. Thus, the values of KREFi obtained always fully represent the actual operating condition of the engine in each subregion of the feedback control region.

A corresponding one of the mean values of KREFi for each subregion of the feedback control region, calculated as described above, is selectively used for control of the air/fuel ratio of the mixture together with the other correction coefficients, that is, the wide-open-throttle correction coefficient KWOT and the mixture-leaning operation correction coefficient KLS, during an open loop control operation immediately following the feedback control operation based upon the $O_2$ sensor output in which the same value KREFi has been calculated. The open loop control operation is carried out in particular engine operating regions such as an engine idle region, a mixture leaning region, a wide-open-throttle operating region, and a decelerating region. More specifically, as shown in FIG. 8, in the wide-open-throttle operating region, the value of $KO_2$ is set to the mean value KREF2 obtained in the $O_2$ sensor output-based feedback control operation, which is the same as the feedback control subregion II, and simultaneously the value of the wide-open-throttle coefficient KWOT is set to a predetermined value of 1.2, and the value of the mixture-leaning coefficient KLS a value of 1.0, respectively. In the mixture leaning region and the decelerating region, the value of $KO_2$ is set to the above mean value KREF3, obtained during feedback control operation in the subregion III, the coefficient KLS a predetermined value of 0.8, and the coefficient KWOT a value of 1.0, respectively. In the idling region,, the value of $KO_2$ is set to the above value KREF1, obtained during feedback control operation in the subregion I, and the coefficients KLS, KWOT are both set to 1.0. Also, until the $O_2$ sensor activation is completed after the engine is started, the values of these coefficients are maintained at the same values as those set at engine idle.

Reverting now to FIG. 5, if the answer to the question of the step 7 is no, that is, if the $O_2$ sensor output level remains at the same level, or if the answer to the question of the step 8 is yes, that is, if the previous loop was an open loop, the air/fuel ratio of the mixture is controlled by integral term control (I-term control). More specifically, whether or not the $O_2$ sensor output level is low is determined at the step 14. If the answer is yes, TDC signal pulses are counted at the step 15, accompanied by determining whether or not the count nIL has reached a predetermined value nI (e.g. 30 pulses), at the step 16. If the predetermined value nI has not yet been reached, the $KO_2$ value is held at its immediately preceding value, at the step 17. If the value nIL is found to have reached the value nI, a predetermined value $\Delta k$ (e.g. about 0.3% of the $KO_2$ value) is added to the $KO_2$ value, at the step 18. At the same time, the number of pulses nIL so far counted is reset to zero at the step 19. After this, the predetermined value $\Delta k$ is added to the $KO_2$ value each time the value nIL reaches the value nI. On the other hand, if the answer to the question of the step 14 is found to be no, TDC pulses are counted at the step 20, accompanied by determining whether or not the count nIH has reached the predetermined value nI at the step 21. If the answer is no at the step 21, the $KO_2$ value is held at its immediately preceding value, at the step 22, while if the answer is yes, the predetermined value $\Delta k$ is subtracted from the $KO_2$ value, at the step 23, and simultaneously the number of pulses nIH so far counted is reset to zero at the step 24. Then, the predetermined value $\Delta k$ is subtracted from the $KO_2$ value each time the value nIH reaches the value nI in the same manner as mentioned above.

Figures 9, 9B:
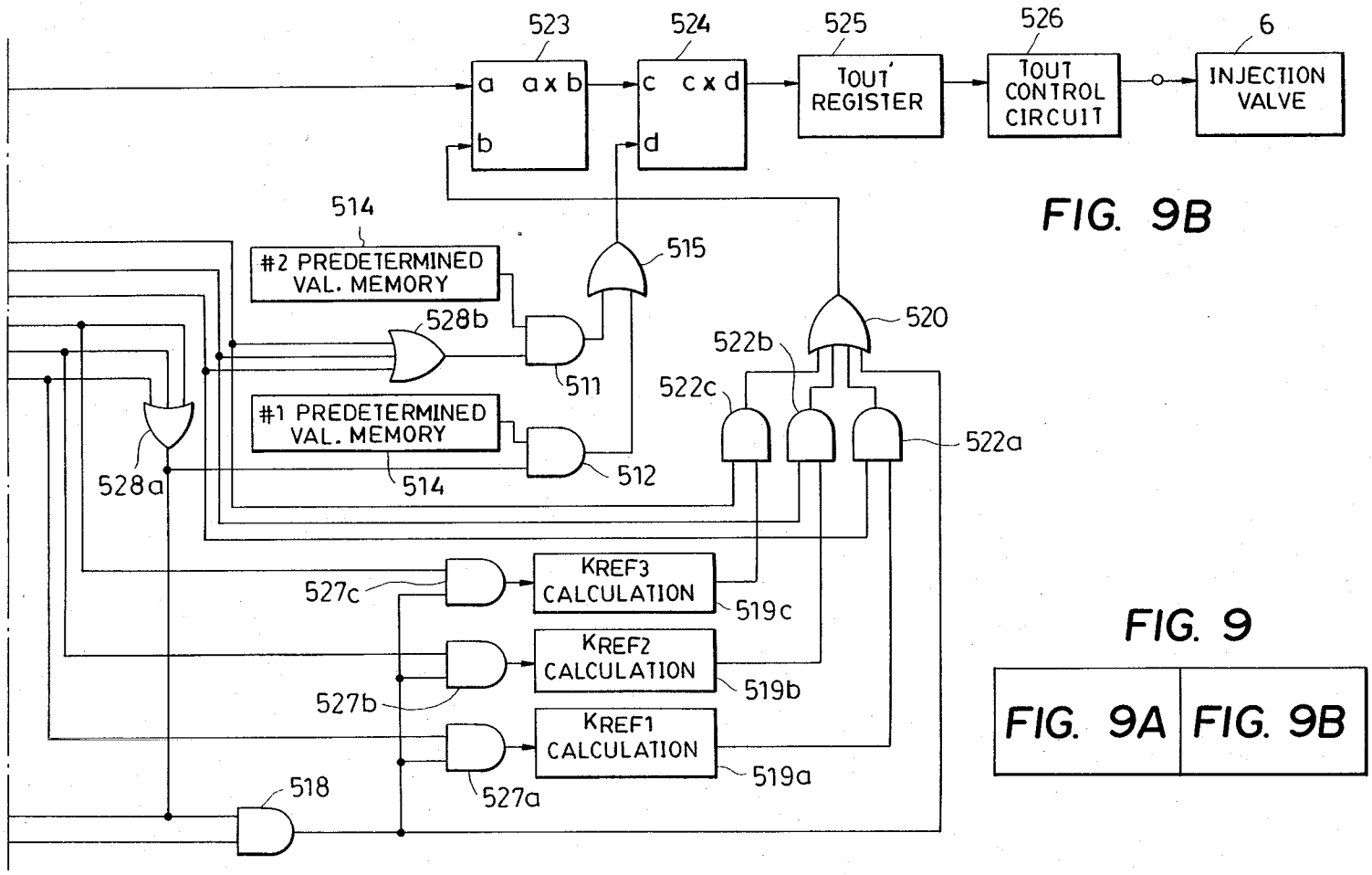
FIGS. 9, 9A and 9B are a circuit diagram illustrating the whole internal arrangement of the ECU, showing in detail a section for calculating correction coefficient $KO_2$ and another correction coefficient KREFi which is the mean value of values of the coefficient $KO_2$.
Figure 9A:
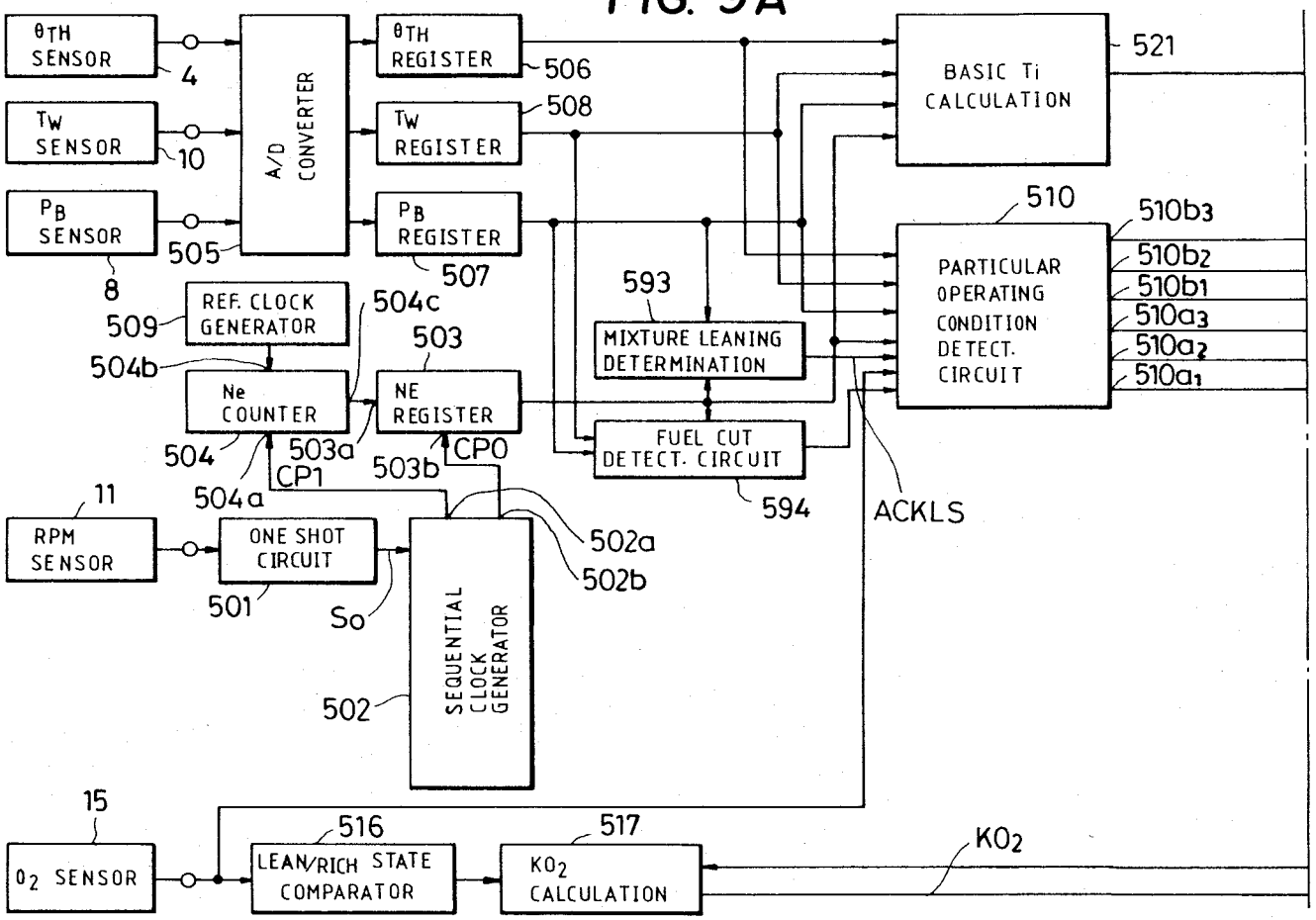
Figure 10:
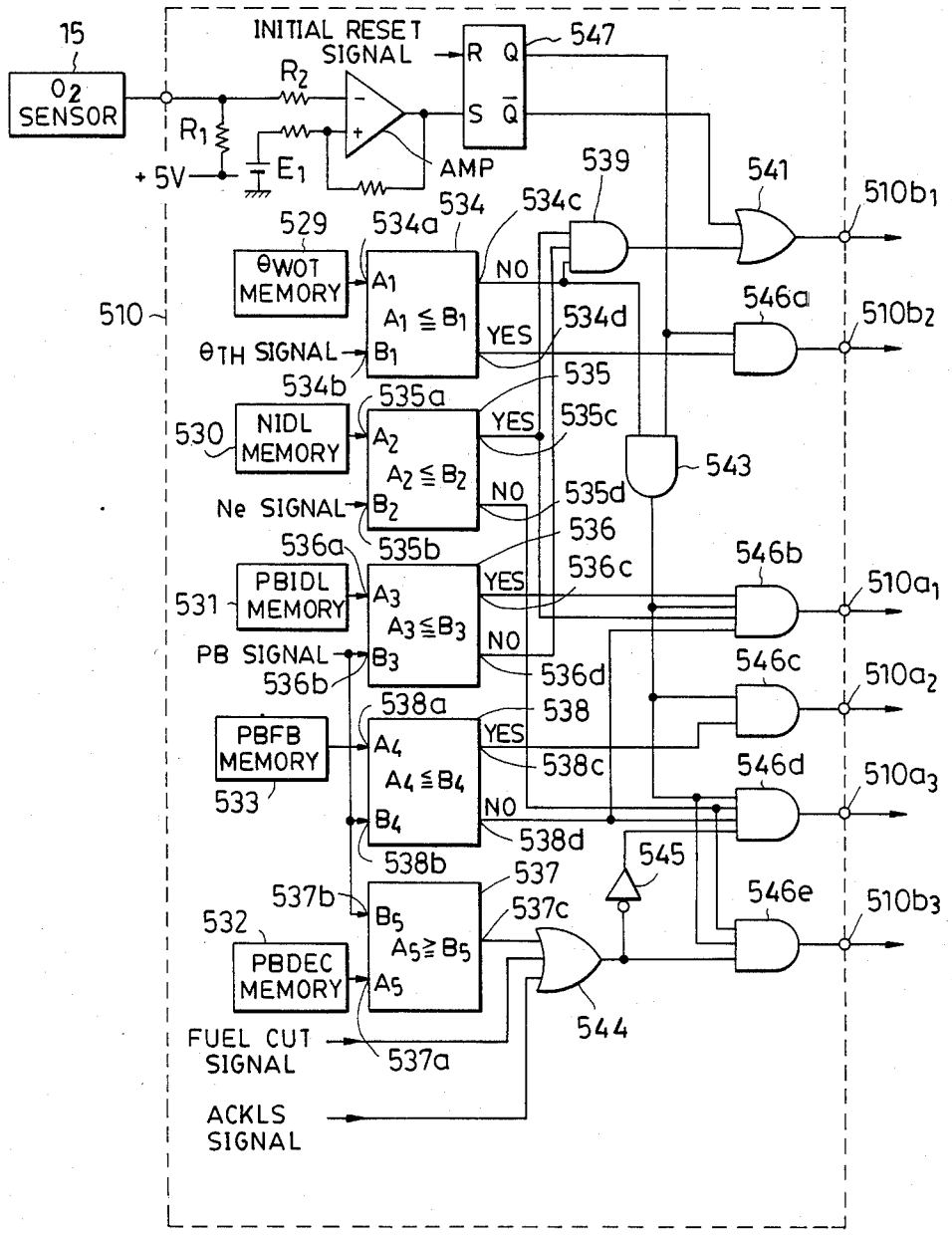
FIG. 10 is a circuit diagram illustrating details of part of a particular operating condition detecting circuit in FIG. 9.

FIGS. 9 and 10 are circuit diagrams illustrating the internal arrangement of the ECU 5 used in the air/fuel ratio feedback control system of the invention described above, in which the engine operation condition determining section, the KREFi value calculating section, and the KREFi value selecting circuit are shown in particular detail.

Referring first to FIG. 9, the whole internal arrangement of the ECU 5 is shown, in which the above KREFi value calculating section and the KREFi value selecting circuit appear. The throttle valve opening ($\theta$th) sensor 4, the engine water temperature (TW) sensor 10 and the absolute pressure (PB) sensor 8, all of which appear in FIG. 1, are connected, respectively, to the inputs of a throttle opening ($\theta$th) register 506, an engine water temperature (TW) register 508 and an absolute pressure (PB) register 507 by way of an analog-to-digital converter unit 505. All the outputs of the $\theta$th register 506, the TW register 508 and the PB register 507 are connected to the inputs of a basic Ti value calculating circuit 521 and an engine operating condition detecting circuit 510. The engine rpm sensor 11, shown in FIG. 1, is connected to a sequential clock generator circuit 502 through a one shot circuit 501. The output terminals 502*a* and 502*b* of the sequential clock generator circuit 502 are connected, respectively, to an input terminal 504*a* of an engine rpm (Ne) counter 504 and an input terminal 503*b* of a engine rpm (Ne) register 503. The engine rpm (Ne) counter 504 has another input terminal 504*b* connected to a reference clock generator 509, while its output terminal 504*c* is connected to the other input terminal 503*a* of the engine rpm (Ne) register 503. Connected to the output of a mixture-leaning operation determining circuit 593 are the aforestated absolute pressure (PB) register 507 and engine rpm (Ne) register 503, while its output is connected to the input of the engine operating condition detecting circuit 510. The aforementioned engine water temperature (TW) register 508, absolute pressure (PB) register 507, and engine rpm (Ne) register 503, are also connected to the input of a fuel-cut detecting circuit 594 which in turn has its output connected to the input of the operating condition detecting circuit 510.

The $O_2$ sensor 15, shown in FIG. 1, is conected to the input of the engine operating condition detecting circuit 510 as well as, to the input of a $KO_2$ calculating circuit 517 through a lean-rich state comparator 516.

The output of the basic Ti calculating circuit 521 is connected to an input terminal a of a first multiplier 523, which in turn has its output connected to an input terminal c of a second multiplier 524. Connected in series to the output of the second multiplier circuit 524 are a TOUT value register 525, a TOUT value control circuit 526 and an injector 6 shown in FIG. 1, in that order. The engine operating condition detecting circuit 510 has input terminals 510$a_1$ through 510$a_3$ connected, respectively, to AND circuits 527*a* through 527*c* at one input terminals as well as to the input of an OR circuit 528*a*. Also, the circuit 510 has output terminals 510$b_1$ through 510$b_3$ connected, respectively, to AND circuits 522*a* through 522*c* at one input terminals and further connected to the input of an OR circuit 528*b*. The OR circuit 528*a* has its output connected, respectively, to the input of the aforementioned $KO_2$ calculating circuit 517 and to the AND circuits 518 and 512 at one input terminals. The output of the OR circuit 528*b* is connected to one input terminal of an AND circuit 511.

The other input terminal of the AND circuit 518 is connected to the output of the $KO_2$ calculating circuit 517 while its output is connected, respectively, to the other input terminals of the AND circuits 527*a* through 527*c* as well as to the input of an OR circuit 520. The outputs of the AND circuits 527*a* through 527*c* are connected to the other input terminals of the respective AND circuits 522*a* through 522*c*, respectively, by way of a KREF1 value calculating circuit 519*a*, a KREF2 value calculating circuit 519*b*, and a KREF3 value calculating circuit 519*c*. The outputs of the AND circuits 522*a* through 522*c* are connected to the input of the OR circuit 520 whose output in turn is connected to the other input terminal b of the first multiplier 523*b*. Connected to the other input terminal of the AND circuit 512 is a first predetermined value memory 513 while its output is connected to the input of an OR circuit 515. The AND circuit 511 has its other input terminal connected to a second predetermined value memory 514 while its output is connected to the input of the OR circuit 515. The output of the OR circuit 515 is connected to the other input terminal d of the second multiplier 524.

Next, the operation of the circuit constructed as above will now be described: The TDC signal picked up by the engine rpm (Ne) sensor 11 appearing in FIG. 1 is applied to the one shot circuit 501 which forms a waveform shaper circuit in cooperation with the sequential clock generator circuit 502 arranged adjacent thereto. The one shot circuit 501 generates an output signal So upon application of each TDC signal pulse thereto, which signal actuates the sequential clock generator circuit 502 to generate clock pulses CP0 and CP1 in a sequential manner. The clock pulse CP0 is supplied to the engine rpm (Ne) register 503 to cause same to store an immediately preceding count outputted from the engine rpm (Ne) counter 504 which counts reference clock pulses generated by the reference clock generator 509. The clock pulse CP1 is applied to the engine rpm counter 504 to reset the immediately preceding count in the counter 504 to zero. Therefore, the engine rpm Ne is measured in the form of the number of reference clock pulses counted between two adjacent pulses of the TDC signal, and the counted reference clock pulse number or measured engine rpm Ne is stored into the above engine rpm register 503.

In a manner parallel with the above operation, output signals of the throttle valve opening ($\theta$th) counter 4, the absolute pressure (PB) sensor 8 and the engine water temperature (TW) sensor 10 are supplied to the A/D converter unit 505 to be converted into respective digital signals which are in turn applied to the throttle valve opening ($\theta$th) register 506, the absolute pressure (PB) register 507, and the engine water temperature (TW) register 508, respectively. The values stored in the above registers and the value stored in the engine rpm register 503 are supplied to the basic Ti calculating circuit 521 and the engine operating condition detecting circuit 510. The values stored in the absolute pressure register 507 and the engine rpm register 503 are also supplied to the mixture-leaning operation determining circuit 593 which in turn is responsive to these input values to supply a binary signal indicative of whether or not the engine is operating in a mixture-leaning condition (ACKLS signal), to the engine operating condition detecting circuit 510. Further, the values stored in the engine rpm register 503, the absolute pressure register 507 and the engine water temperature register 508 are also supplied to the fuel-cut detecting circuit 594 which in turn is responsive to these input values to supply the engine operating condition detecting circuit 510 with a binary signal indicative of whether or not the engine is in a fuel-cut condition. The basic Ti calculating circuit 521 is responsive to the values inputted from the above registers 503, and 506–508 to carry out calculations of the values of the coefficients for determination of the basic fuel injection period Ti. As described in detail later, the engine operating condition detecting circuit 510 is also supplied with an output signal from the $O_2$ sensor 15 in FIG. 1 and responsive to the value of the same output signal to determine whether or not the activation of the $O_2$ sensor 15 has completed. After determining the completion of the activation of the $O_2$ sensor 15, the circuit 510 is also responsive to the inputs from the registers 503 through 508 and the detecting circuits 593 and 594 to further determine in which one of the first to third operating subregions shown in FIG. 8 of the feedback control region and the particular operating regions (for instance, wide-open-throttle region, idling region, decelerating region and mixture-leaning region) the engine is operating. If the engine is operating in one of first to third operating subregions of the feedback control region, the circuit 510 generates an output of 1 as a command signal through one of its output terminals 510$a_1$–510$a_3$. That is, for example, when the engine is operating in the first operating subregion I of the feedback control region, shown in FIG. 8, the engine operating condition detecting circuit 510 generates an output command signal of 1 only through its output terminal 510$a_1$ and supplies this signal to the $KO_2$ calculating circuit 517, while at the same time energizing the AND circuits 518, 512 and 527*a*. A predetermined coefficient value applicable to the feedback control (e.g. KWOT=1.0, KLS=1.0) is then supplied from the first predetermined value memory 513, which is connected to the other input terminal of the AND circuit 512, to the second multiplier 524, through the OR circuit 515, as long as the AND circuit 512 is in an energized state.

On the other hand, the output signal of the $O_2$ sensor 15 in FIG. 1 is inputted to the lean/rich state comparator 516 in FIG. 9, which in turn determines whether or not the output level of the $O_2$ sensor 15 is low or high. The resultant lean/rich state-discriminating signal is applied to the $KO_2$ calculating circuit 517 which is also supplied with the output signal from the engine operating condition detecting circuit 510 through its output terminal 510$a_1$. The $KO_2$ calculating circuit 517 is responsive to the above lean/rich state-discriminating signal to calculate the value of $KO_2$, and the resultant calculated value $KO_2$ is applied to one input terminal of an AND circuit 518. The AND circuit 518 is supplied at its other input terminal with the output signal of 1 from the engine operating condition detecting circuit 510 through its output terminal 510$a_1$ to energize the AND circuit 518. The AND circuit 518 allows the calculated $KO_2$ value signal supplied from the $KO_2$ calculating circuit 517 to be applied as a first coefficient b to the input terminal b of the first multiplier 523 through the OR circuit 520. The first multiplier 523 has its other input terminal a supplied with a basic value signal as input a from the basic Ti calculating circuit 521 to multiply this Ti value a by the above calculated $KO_2$ value b, and the resultant product signal $a \times b$ or $Ti \times KO_2$ is applied as input c to the input terminal c of the second multiplier 524. This second multiplier 524 has its other input terminal d supplied with the values of coefficients KWOT, KLS applicable during closed loop control (both having a value of 1.0) as input d, to multiply the above product $a \times b$ equalling $Ti \times KO_2$ by the values of coefficients KWOT, KLS to obtain a basic value TOUT (which is substantially equal to the output product of the first multiplier 523). This basic value TOUT is applied to the TOUT value control circuit 526 through the TOUT value register 525. The TOUT value control circuit 526 performs an arithmetic operation using the aforementioned basic equation by adding to and/or multiplying the value TOUT by the aforementioned other correction coefficients and constants (KTA, KAFC, KPA, KAST, etc. and constants TACC, TDEC, TV, etc.), results of which are supplied to the main injectors as driving outputs. The output of the AND circuit 518 that is the $KO_2$ value is also supplied to the KREF1 calculating circuit 519*a* through the energized AND circuit 527, which in turn calculates the KREF1 mean value from $KO_2$ values successively inputted thereto during engine operation in the feedback control subregion I and the resultant KREF1 mean value is applied to one input terminal of the AND circuit 522*a*.

When the engine is operating in the feedback control regions II and III shown in FIG. 8, similar operations to the above-mentioned one are carried out. For example, when the engine is operating in the subregion II of the feedback control region, the engine operating condition detecting circuit 510, generates an output of 1 through its output terminal 510$a_2$, and when the engine is operating in the subregion III, the circuit 510 generates an output of 1 through its output terminal 510$a_3$ and in either case the $KO_2$ values are supplied to the first multiplier 523, while at the same time the KREF2 and KREF3 values calculated by the KREF2 calculating circuit 519*b* and the KREF3 calculating circuit 519*c*, respectively, are supplied to the AND circuits 522*b* and 522*c*, respectively, through one of their input terminals. Next, when the engine operating condition detecting circuit 510 determines that the engine is operating in a particular operating condition other than the feedback region, the output signals of the circuit 510 through all of the above output terminals, namely 510*a*$_1$ through 510*a*$_3$ become 0, deenergizing the AND circuits 512, 518 and 527*a* through 527*c* to prohibit the transfer of $KO_2$ values from the $KO_2$ value calculating circuit 517 to the first multiplier 523. Further, no new $KO_2$ values are supplied to the KREFi value calculating circuits 519*a* through 519*c* so that these circuits continue to maintain the last KREFi values already stored, without updating same.

On the other hand, during engine operation in such a particular operating condition, an output signal of 1 is outputted through one of the output terminals 510*b*$_1$, through 510*b*$_3$ of the engine operating condition detecting circuit 510. For example, when the engine is operating in the idle region, an output signal of 1 is outputted through the output terminal 510*b*$_1$ and this output signal of 1 is supplied to one input terminal of the AND circuit 522*d* and also to one input terminal of the AND circuit 511 through the OR circuit 528*b* to activate these AND circuits. The AND circuit 511 has its other input terminal supplied with the stored value from the second predetermined value memory 513. The second predetermined value memory 514 stores values of the coefficients applicable during engine operation in particular engine operating conditions (for instance, at wide-open-throttle region: KWOT=1.2, KLS=1.0; at mixture-leaning region: KWOT=1.0, KLS=0.8; at decelerating region: KWOT=1.0, KLS=0.8; at idling region: KWOT=1.0, KLS=1.0). The stored value from the second predetermined value memory 514 is supplied to the second multiplier 524, as long as the AND circuit 511 is in an energized state. As previously noted, the KREF1 value from the KREF1 calculating circuit 519*a* is supplied to the energized AND circuit 522*a*, which in turn supplies this value to the first multiplier 523 through the OR circuit 520. In this way, when the engine is operating in the idling region, the KREF1 valve calculated from the $KO_2$ values during engine operation in the feedback subregion I is supplied to the first multiplier 523, in place of the $KO_2$ value.

Even when the engine is operating in another particular operating region, a similar process to the above-mentioned one is carried out. That is, when the engine is operating in the wide-open-throttle region, an output signal of 1 is outputted through the output terminal 510*b*$_2$ of the engine operating condition detecting circuit 510, and when the engine is operating either in the mixture-leaning region or in the decelerating region, an output signal of 1 is outputted through the output terminal 510*b*$_3$ of the same circuit, and accordingly the stored value in the second predetermined value memory 514 is supplied to the second multiplier 524 while at the same time the respective KREF2 and KREF3 values are supplied to the first multiplier 523, in place of $KO_2$ values.

The first multiplier 523 calculates a product of a basic value Ti and a calculated mean value KREFi to apply the resultant signal to the second multiplier 524, in the same manner as previously described. During the open loop control operation, the second multiplier 524 is supplied with the values of coefficients KWOT, KLS as a value d of the second coefficients from the second predetermined value memory 514, through the AND circuit 512 and the OR circuit 515, to multiply a product value supplied from the first multiplier 523 by the value d of these second coefficients. The resultant product signal is supplied to the TOUT value control circuit 526 through the TOUT value register 525, and then the TOUT value control circuit 526 performs a valve opening period control operation similar to that performed during the feedback control operation as previously described.

FIG. 10 is a circuit diagram illustrating the internal arrangement of the engine operating condition detecting circuit 510, shown in FIG. 9. Resistors R1 and R2 are connected in series to the inverting input terminal of an operational amplifier, AMP, and the resistor $R_1$ is also connected to a reference voltage supply (e.g. +5 V) thus forming a comparator. The $O_2$ sensor shown in FIG. 1 is connected to the junction of the resistors R1 and R2. A reference voltage supply $E_1$ is connected to the non-inverting input terminal of the operational amplifier AMP. The output of the operational amplifier AMP is connected to a set pulse input terminal S of an RS flip flop 547 which in turn has a reset pulse input terminal R connected to the ignition switch 17, shown in FIG. 1. The output terminal Q of the RS flip flop is connected to one input terminal of each of AND circuits 546*a* and 543, while its output terminal $\overline{Q}$ is connected to the input an OR circuit 541. Comparators 534 through 538 have respective input terminals 534*a* through 538*a* connected to a θWOT value memory 529, an NIDL value memory 530, a PBIDL value memory 531, a PBDEC value memory 532 and a PBFB value memory 533, respectively. The comparators 534 and 535 have respective output terminals 534*b* and 535*b* connected to the θth value register 506, and the Ne value register 503, respectively, both appearing in FIG. 9. The comparators 536, 537 and 538 have respective input terminals 536*b*, 537*b*, and 538*b* connected to the PB value register 507, shown in FIG. 9. The comparator 534 has an output terminal 534*c* connected to the inputs of AND circuits 539 and 543, and a second output terminal 534*d* to the other input terminal of the AND circuit 546*a*, respectively. The comparator 535 has an output terminal 535*c* connected to the outputs of AND circuits 539 and 546*b*, and a second output terminal 535*d* to the inputs of AND circuits 546*d* and 546*e*, respectively. The comparator 536 has an output terminal 536*c* connected to the input of the AND circuit 546*b*, and a second output terminal 536*d* to the input of the AND circuit 539, respectively. The comparator 537 has an output terminal 537*c* connected to the input of an OR circuit 544. The comparators 538 has an output terminal 538*c* connected to the output of an AND circuit 546*c*, and a second ouput terminal 538*d* to the outputs of the AND circuits 546*b* and 546*d*, respectively. The output of the AND circuit 539 is connected to the input of the OR circuit 541. Further, the input of the OR circuit 544 is connected to the outputs of the mixture-leaning operation-detecting circuit 593 and the fuel-cut determining circuit 594, both appearing in FIG. 9, while the output of the OR circuit 544 is connected directly to the input of the AND circuit 546*e*, and also to the input of the AND circuit 546*d* through an inverter 545. Also, the output of the AND circuit 543 is connected to the inputs of the AND circuits 546*b* through 546*e*. The outputs of the AND circuits 546*b* through 546*d* are conected to output terminals 510*a*$_1$ through 510*a*$_3$ of the engine operating condition detecting circuit 510, while the OR circuit 541, and the AND circuits 546*a*, 546*e* are connected to output terminals 510*b*$_1$ through 510*b*$_3$ of the circuit 510, respectively.

Next, the operation of the circuit constructed as above will now be explained: The $O_2$ sensor has the characteristic that as its activation proceeds, its output voltage level drops due to a reduction in its internal resistance. The operational amplifier AMP has its inverting input terminal supplied with the output of the $O_2$ sensor and its non-inverting input terminal with a predetermined reference voltage level $E_1$ (e.g. 0.6 V), respectively. When the output voltage level of the $O_2$ sensor drops below the above predetermined reference voltage level $E_1$, the operational amplifier AMP generates a high level output of 1 and applies it to the set pulse input terminal S of the RS flip flop 547. The RS flip flop has its reset pulse input terminal R supplied with an initial reset signal at the start of the engine upon turning the ignition switch 17 on, to generate an output of 0 at its output terminal Q as well as an output of 1 at its output terminal $\overline{Q}$. Until the complete activation of the $O_2$ sensor 15, this output signal of 1 from the terminal $\overline{Q}$ is applied to the output terminal 510*b* through the OR circuit 541. When supplied with the output of 1 from the operational amplifier AMP, the RS flip flop 547 generates an output of 1 at its output terminal Q and applies it to one input terminals of the AND circuits 546*a* and 543 as an $O_2$ sensor activation-indicative signal.

The aforesaid memories, namely, the $\theta$WOT value memory 529, the NIDL value memory 530, the PBIDL value memory 531, the PBDEC value memory 532, and the PBFB value memory 533 store respective predetermined values for determination of various particular operating conditions of the engine, that is, the wied-open-throttle region, the idling region, the decelerating region and the feedback control region. First, the comparator 534, when a predetermined $\theta$WOT value (e.g. 50 degrees) is lower than or equal to the actual throttle valve opening value $\theta$th, that is, when the relationship of $A_1 \leqq B_1$ stands, generats and output of 1 through its output terminal 534*d* and an output of 0 through its output terminal 534*c*, respectively. The output of 0 through the output terminal 534*c* deenergizes the AND circuit 539, and the AND circuit 543, thereby further deenergizing the AND circuits 546*b* through 546*e*. On the other hand, the output of 1 through the output terminal 534*d* is supplied to an input terminal of the AND circuit 546*a* which simultaneously has its other input terminal supplied with an output of 1 from the RS flip flop 547 through the output terminal Q. Therefore, the AND circuit 546*a* alone generates an output of 1, and accordingly the engine operating condition detector 510 generates an output of 1 through the output terminal 510*b*$_2$.

When the throttle valve opening value $\theta$th becomes lower than the predetermined value $\theta$WOT, the comparator 534 generates an output of 0 through its output terminal 534*d* and an output of 1 through its output terminal 534*c*, respectively, the latter being applied to the AND circuits 539 and 543. When the actual engine rpm Ne becomes smaller than or equal to a predetermined rpm NIDL (e.g. 1000 rpm), that is, the input relationship $A_2 \leqq B_2$ stands, where $A_2$ is an input corresponding to the predetermined rpm NIDL, and $B_2$ an input corresponding to a counted value of the interval between two adjacent pulses of the TDC signal, dependent on the engine rpm Ne, the comparator 535 generates an output of 1 through its output terminal 535*c* and applies it to the AND circuits 539 and 546*b*. When the input relationship $A_2 > B_2$ stands, the same comparator 535 generates an output of 1 through its output terminal 535*d* and applies it to the AND circuit 546*d*. The NIDL value memory 530 stores a reciprocal of the predetermined value NIDL for the convenience of comparison with the actual engine rpm Ne which is obtained in the form of a number of reference clock pulses counted between two adjacent pulses of the TDC signal. When the actual absolute pressure PB becomes higher than or equal to a predetermined absolute pressure PBIDL (e.g. 360 mmHg), or when the input relationship $A_3 \leqq B_3$ stands, the comparator 536 generates an output of 1 through its output terminal 536*c* and applies it to the AND circuit 546*b*. When the input relationship $A_3 > B_3$ stands, the same comparator generates an output of 1 through its output terminal 536*c*, and an output of 1 through it output terminal 536*d*, respectively, and these outputs are applied to the AND circuits 546, and 539, respectively.

When the actual absolute pressure PB becomes lower than or equal to a predetermined absolute pressure PBDEC, that is, when the input relationship $A_5 \geqq B_5$ stands, the comparator 537 generates an output of 1 and applies it to the OR circuit 544. The OR circuit 544 is further supplied with a fuel-cut signal having a high level of 1, when the fuel-cut detecting circuit 594 determines that the engine is operating in the fuel-cut region, shown in FIG. 9, and is supplied with an ACKLS value signal having a high level of 1 when the mixture-leaning operation determining circuit 593 determines that the engine is operating in the mixture-leaning region, also shown in FIG. 9. When a signal having a high level of 1 is supplied to one of the three input terminals of the OR circuit 544, the OR circuit generates an output of 1 and applies it to the AND circuit 546*e* while at the same time the same output of 1 is inverted into a low level of 0 by the inverter 545 and applied to the AND circuit 546*d*. If no high level signal of 1 is supplied to any one of the three input terminals of the OR circuit 544, an output of 0 is generated by the OR circuit 544, inverted into a high level of 1 by the inverter 545 and supplied to the AND circuit 546*d*.

When the actual absolute pressure PB becomes higher than or equal to a predetermined absolute pressure PBFB (e.g. 600 mmHg), that is, when the input relationship $A_4 \leqq B_4$ stands, the comparator 538 generates an output of 1 through its output terminal 538*c* and applies it to the AND circuit 546*c*, and when the input relationship $A_4 > B_4$ stands, the same comparator generates an output of 1 through its output terminal 538*d* and applies it to AND circuit 546*d*.

When an $O_2$ sensor activation-indicative signal having a high level of 1 and another signal having a high level of 1 indicative of the actual throttle valve opening value $\theta$th being smaller than a predetermined throttle valve opening value $\theta$WOT are supplied to both of the input terminals of the AND circuit 543, the AND circuit 543 generates an output of 1 and applies it to each of the AND circuits 546*b* through 546*e*. If, simultaneously at this stage, an output of 1 generated by the comparator 535 consequent upon the actual engine rpm Ne being lower than or equal to the predetermined rpm NIDL, an output of 1 generated by the comparator 536 consequent upon the actual absolute pressure PB being higher than or equal to the predetermined absolute pressure PBIDL, and yet another output of 1 generated by the comparator 538 consequent upon the actual absolute pressure PB being lower than the predetermined absolute pressure PBFB, are all applied to the AND circuit 546*b*, that is, if the condition for determining that the engine is operating in the feedback control subregion I shown in FIG. 8, is satisified, the AND circuit 546*b* generates an output of 1 and supplies it to the output terminal 510$a_1$, of the operating condition detecting circuit 510.

When an output of 1 from the comparator 538, consequent upon the actual absolute pressure PB being higher than or equal to the predetermined absolute pressure PBFB, is applied to the other input terminal of the AND circuit 546*c*, that is, the condition for determining that the engine is operating in the feedback control subregion II, shown in FIG. 8, is satisfied, the AND circuit 546*c* generates an output of 1 and supplies it to the output terminal 510$a_2$ of the operating condition detecting circuit 510.

In the same way, when the actual throttle valve opening value $\theta$th is lower than the predetermined throttle valve opening value $\theta$WOT and the $O_2$ sensor activation is completed, (1) when the engine is determined to be operating in the feedback control subregion III, that is, when the relationships PBFB>PB, PBDEC<PB and NIDL<Ne all stand and at the same time, if the engine is operating in neither of the mixture-leaning subregion and the fuel-cut subregion, an output of 1 from the AND circuit 546*d* is supplied to the output terminal 510$a_3$ of the operating condition detecting circuit 510, (2) when the engine is determined to be operating in the idling region, that is, when the relationships NIDL≧Ne and PBIDL>PB both stand, an output of 1 from the AND circuit 539 is supplied to the output terminal 510$b_1$ of the circuit 510 through the OR circuit 541, and (3) when the engine is determined to be operating in either the decelerating region or the mixture-leaning region, that is, when the relationships PBDEC≧PB and NIDL<Ne both stand and at the same time either one of the fuel-cut signal having a high level of 1 and the mixture-leaning signal (ACKLS signal) having a high level of 1 is generated, an output of 1 from the AND circuit 546*e* is supplied to the output terminal 510$b_3$ of the circuit 510.

Although in the foregoing embodiment the feedback region is divided into three subregions for purposes of explanation, it may be divided into more subregions depending on the operating characteristics of the engine. Also, when the engine is operating in a particular operating region, any one of the KREFi value may be used and is not limited to the KREFi value used in the foregoing embodiment. For example, although in the above embodiment it was shown as an illustration that the KREF3 value obtained from the mean value of $KO_2$ values in the feedback subregion III is applied to engine operation in the decelerating region, the KREF1 value obtained from the feedback subregion I may alternatively be applied, to the decelerating region, depending on the operating characteristics of the engine.

What is claimed is:

1. An air/fuel ratio feedback control system for an internal combustion engine having an exhaust system, comprising: a sensor arranged in said exhaust system of said engine, for detecting the concentration of exhaust gases emitted from said engine, and electrical circuit means for controlling the air/fuel ratio of an air/fuel mixture being supplied to said engine to a predetermined value, by the use of a first coefficient having a value variable in response to the output of said sensor, said electrical circuit means including means for detecting operating conditions of said engine inclusive of a plurality of divided subregions of a feedback control region in which is effected the control of the air/fuel ratio of said air/fuel mixture responsive to an output generated by said sensor, and a plurality of particular operating regions other than said feedback control region, means for calculating a mean value of values of said first coefficient occurring when said engine is operating in each of said divided subregions of said feedback control region, and means for selecting one of such calculated mean values of said first coefficient corresponding to each of said particular operating regions, when it is detected by said operating condition detecting means that said engine is operating in said each particular operating region, and means for controlling the air/fuel ratio of said air/fuel mixture by the use of said one selected mean value, in place of said first coefficient, while said engine is operating in said each particular operating region.

2. An air/fuel ratio feedback control system as claimed in claim 1, wherein said electrical circuit means includes means for generating at least one second coefficient having a value variable in response to an output generated by said operating condition detecting means, said second coefficient generating means being operable to hold the value of said second coefficient at a first predetermined value while said engine is operating in said feedback control region, and to hold the value of said second coefficient at a second predetermined value corresponding to one of said particular operating regions while said engine is operating in said one particular operating region, and means operable to control the air/fuel ratio of said air/fuel mixture, by the use of both said first coefficient and said second coefficient while said engine is operating in said feedback control region, and by the use of both one of said selected mean values of said first coefficient and said second coefficient while said engine is operating in one of said particular operating regions to which said one selected mean value corresponds.

* * * * *